United States Patent [19]

Cuny

[11] Patent Number: 4,767,091

[45] Date of Patent: Aug. 30, 1988

[54] ANTIFALL SAFETY DEVICE

[75] Inventor: Bernard G. Cuny, Saint Nizier d'Uriage, France

[73] Assignee: G.A.M.E.S., Saint Nizier d'Uriage, France

[21] Appl. No.: 174

[22] Filed: Jan. 2, 1987

[30] Foreign Application Priority Data

Jan. 3, 1986 [FR] France ..... 86 00065

[51] Int. Cl.[4] ..... A62B 35/00; B66C 1/64; E04G 17/18

[52] U.S. Cl. ..... 248/228; 182/3; 182/36; 294/85; 294/104; 294/902

[58] Field of Search ..... 294/85, 92, 101, 103.1, 294/104, 106, 902; 104/258; 182/3, 36, 230; 248/72, 228, 231.5, 316.5

[56] References Cited

U.S. PATENT DOCUMENTS

| | | | |
|---|---|---|---|
| 1,024,611 | 4/1912 | Bates | 104/258 |
| 1,646,244 | 10/1927 | Hassler | 248/228 X |
| 1,795,808 | 3/1931 | Thompson | 248/228 |
| 1,831,676 | 11/1931 | Long | 104/258 |
| 2,354,746 | 8/1944 | Duzmal | 248/228 |
| 2,422,865 | 6/1947 | Tucker | 294/85 X |
| 3,257,144 | 6/1966 | Gardner | 294/110 |
| 3,276,800 | 10/1966 | Loudon et al. | 248/72 X |
| 3,348,632 | 10/1967 | Swager | 182/230 |
| 4,052,028 | 10/1977 | Cordero | 248/228 |
| 4,352,409 | 10/1982 | Fountain | 182/8 |
| 4,606,430 | 8/1986 | Roby et al. | 182/3 |

FOREIGN PATENT DOCUMENTS

| | | | |
|---|---|---|---|
| 802932 | 2/1951 | Fed. Rep. of Germany | 294/85 |
| 841894 | 6/1952 | Fed. Rep. of Germany | 248/228 |
| 860542 | 12/1952 | Fed. Rep. of Germany | 294/85 |
| 2010379 | 9/1971 | Fed. Rep. of Germany | 248/228 |
| 719073 | 2/1932 | France . | |
| 2086326 | 12/1971 | France . | |
| 2555060 | 5/1985 | France . | |
| 219164 | 2/1985 | German Democratic Rep. | 294/85 |
| 833137 | 4/1960 | United Kingdom . | |
| 1342723 | 1/1974 | United Kingdom . | |
| 2024304 | 1/1980 | United Kingdom . | |
| 1567079 | 5/1980 | United Kingdom . | |

*Primary Examiner*—Johnny D. Cherry
*Attorney, Agent, or Firm*—Owen, Wickersham & Erickson

[57] ABSTRACT

A safety device for mounting on a beam section including a body comprising two articulated portions having projections which produce a wedging effect on the beam section when under the pull of a load.

39 Claims, 4 Drawing Sheets

ANTIFALL SAFETY DEVICE

The present invention relates to an antifall safety device suitable for being mounted on a beam section and to which a load may be made fast in order to be retained.

A device of this type is known at present, comprising two pairs of arms connected by a deformable parallelepiped, the ends of the arms of both pairs of arms having facing grooves into which are extended the two opposite edges of a beam section so that, under the action of a load in one direction, the lengthwise edges of the beam section become wedged in the grooves. Furthermore, other devices are known, which comprise movable bearing pieces which are connected to the load and which, under the effect of this load, lock the body of the device. Apart from their complexity, these antifall safety devices have the disadvantage of producing their effects only in one direction, with the result that they need to be associated with a beam section which is arranged substantially vertically.

The present invention, on the other hand, offers a rigid antifall safety device, without any moving part, which may be associated with any beam section, whatever the latter's position in space, and which is capable of operating whatever the direction in which the loads acts. Its structure, furthermore, is particularly simple.

The antifall safety device according to the present invention is suitable for being mounted on a lengthwise part of a beam section which comprises two opposed lengthwise edges, an external lengthwise surface joining these lengthwise edges and two lengthwise surface parts opposed to this external lengthwise surface and adjacent to the lengthwise edges.

The antifall safety device according to the present invention comprises a body in which there is arranged a C-shaped passage for receiving part of the beam section. This body has a central portion which extends facing and at a distance from the external lengthwise surface of the beam section, two opposed side walls extending along the two opposed edges of the beam section and two flanges extending facing the lengthwise surface portions of the beam section. According to the present invention, the central portion is provided with at least one projecting portion extending towards the external lengthwise surface of the beam section and having at its end at least one corner forming a punch situated between the side walls so that, under the pull of the said load, a tilting of the body is produced, together with a wedging action of the said lengthwise portion of the beam section in the passage, with the corner of the projecting portion of the body bearing on the external lengthwise surface of the beam section and producing a punch action, with a view to retaining the body in relation to the beam section and consequently preventing the fall of the load which is made fast to it.

According to the present invention, the central portion of the body is preferably provided with two projecting corners forming a punch, which are at a distance in the lengthwise direction of the beam section and which are capable of producing a punch action on the lengthwise surface of the beam section.

According to the present invention, the central portion of the body is preferably equipped with two projecting corners forming a punch, which are at a distance in the width direction of the beam section and capable of producing a punch action on the external lengthwise surface of the beam section.

According to the present invention, at least one of the flanges of the body may advantageously be provided with at least one projecting portion extending towards the lengthwise surface portion of the beam section situated opposite and having at its end at least one corner capable of producing a punch action on this lengthwise surface portion of the beam section.

According to the present invention, the flange is preferably provided with two projecting portions which are at a distance in the lengthwise direction of the beam section.

According to the present invention, the opposed side walls extending along the two opposed edges of the beam section may comprise at least two opposed bearing members joined to the body by means of resilient members in order to maintain the device in a position without, however, opposing its movement to enable it to be adjusted to a predetermined position along the beam section.

According to another alternative form, the opposed side walls extending along the two opposed edges of the beam section may comprise at least two opposed roller wheels, these roller wheels being preferably mounted on the body by means of annular resilient members.

Furthermore, the body may carry buffers, preferably in the form of rollers, made of a resilient material acting on the beam section.

According to the present invention, the body may advantageously comprise two articulated portions permitting at least one of the flanges to be freed, with a view to mounting the body on the beam section anywhere along its length. In this alternative form, these two articulated portions forming the body are preferably held closed by the means for suspending the load on the body. Preferably, their lengthwise articulation axis is offset transversely in relation to the position of the means for suspending the load, the articulated portions having surfaces which come to bear on each other when these members are in a closed position.

The present invention will be better understood from the study of the antifall safety devices described by way of examples without implying any limitation and illustrated by the drawing, in which.

Figure 1:
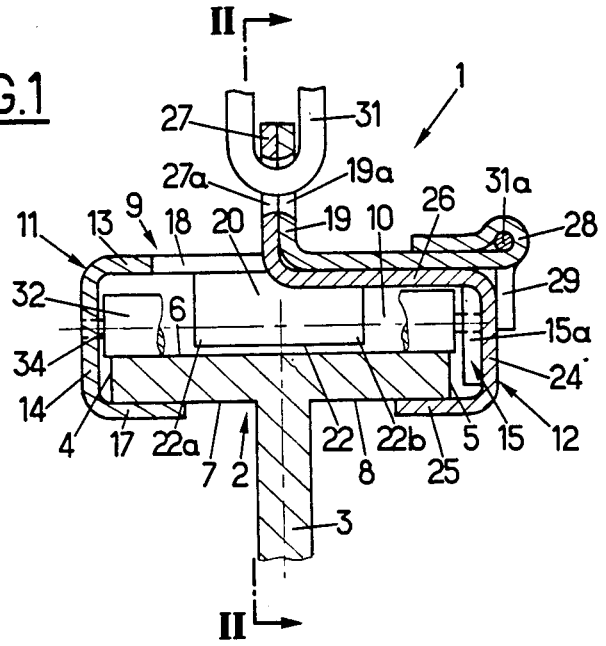
FIG. 1 shows a cross-section of a first antifall safety device according to the present invention, mounted on a beam section, in closed position.
Figure 2:
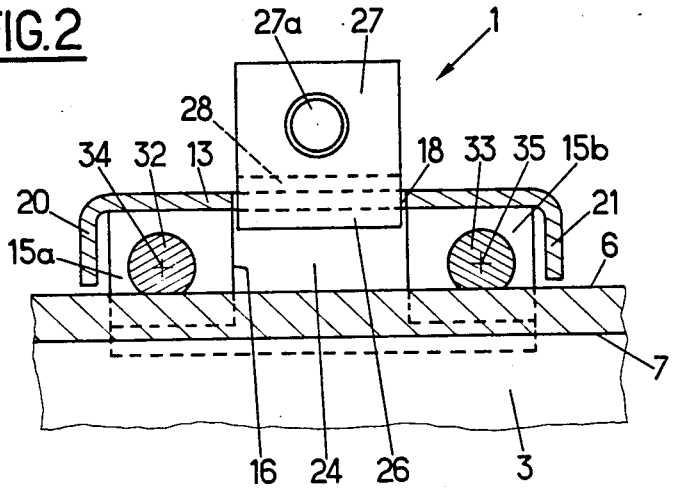
FIG. 2 shows a lengthwise section along II—II of the antifall safety device of FIG. 1.

The antifall safety device shown in FIGS. 1 to 4 and indicated generally by the reference 1, is, in the example, suitable for being mounted on a portion 2 of a beam section 3 which has two opposed edges 4 and 5, an external lengthwise surface 6 joining the edges 4 and 5 and two lengthwise surface portions 7 and 8 opposing the outer surface 6 and adjacent to the lengthwise edges 4 and 5. In the example the beam section 3 is an I- or T-section beam section. The lengthwise portion 2 could, however, consist of a flat iron bar.

The safety device 1 comprises a rigid body indicated generally by reference 9, in which there is arranged a passage 10 receiving the lengthwise portion 2 of the beam section 3.

In the example, the rigid body 9 comprises two portions 11 and 12 which are articulated to each other and which are made of thick bent sheet metal.

The articulated portion 11 comprises a rectangular middle portion 13 which extends facing and at a distance from the external lengthwise surface 6 of the beam section 3. This middle portion 13 is extended at right angles, on the onne hand by a side wall 14 which extends along the lengthwise edge 4 of the beam section 3 and, on the other hand, by a side wall 15 which extends along the lengthwise edge 5 of the beam section 3, this side wall 15 being in two parts 15*a* and 15*b* which are at a distance in the lengthwise direction of the beam section and which between them form a passage 16.

In addition, the side wall 14 of the articulated portion 13 is extended at right angles by a flange 17 opposite to the middle portion 13 and extending facing the lengthwise surface portion 7 of the beam section 3.

The middle portion 13 of the articulated portion 11 has a through passage 18 and a lug 19 folded at right angles and extending outwards from the edge of the passage 18 situated at the side of its side wall 15 and parallel to the lengthwise axis of the beam section 3.

Starting at its lengthwise ends, the middle portion 13 of the articulated portion 11 has two portions 20 and 21, which are folded at right angles and which extend projecting from the middle portion 13 towards the median zone of the external lengthwise surface 6 of the beam section 3. These projecting portions 20 and 21 have end edges 22 and 23 (FIG. 4) facing the external lengthwise surface 6 of the beam section 3 and, at the ends of its edges 22 and 23, corners 22*a*, 22*b* and 23*a*, 23*b*, which are at a distance in the transverse direction of the beam section 2.

The other articulated portion 12 comprises a side wall 24 which extends outwards from the side wall 15 of the articulated portion 11 and over its entire length, and which is extended at right angles by a lengthwise flange 25 which extends facing the lengthwise surface portion 8 of the beam section 3, this lengthwise flange 25 being opposed to the lengthwise flange 17 of the articulated portion 11.

The articulated portion 12 also has a transverse lug 26 which extends through the passage 16 in the side wall 15 of the articulated portion 11 and then between the middle portion 13 of the articulated portion 11 and the external lengthwise surface 6 of the beam section 3, this lug 26 having a right-angled extension 27 which crosses the passage 18 of the middle portion 13 of the articulated portion 11.

In order to join via an articulation the articulated portions 11 and 12, the middle portion 13 of the articulated portion 11 has an outward extension 28 which extends from its lengthwise edge adjacent to the transverse passage 16 and the side wall 24 of the articulated portion 12 has, opposite its lengthwise flange 26, two extensions 29 and 30 situated at each side of the extension 28 of the articulated portion 11. These extensions 28, 29 and 30 are folded back so as to form a lengthwise space for receiving an articulation pivot 31*a*. Naturally, the extensions 28, 29 and 30 could be replaced by an appended hinge with a lengthwise axis.

In the closed position which can be seen in FIG. 1, the articulated portions 11 and 12 of the safety device 1 are arranged as follows. The lengthwise wall 24 of the articulated portion 11 bears substantially on the outer face of the portions 15*a* and 15*b* of the side wall 15 of the articulated portion 11, its lengthwise flange 25 extends in the same plane as the lengthwise flange 17 of the articulated portion 11, its transverse lug 26 bearing substantially on the inner face of the middle portion 13 of the articulated portion 11, and the extension 27 of this lug 26 bears substantially against the lug 19 of the articulated portion 11, on the side of the passage 18. The portion 2 of the beam section 3 thus extends in the passage 10 defined by the opposed side walls 14 and 15 of the articulated portion 11, by the end edges 22 and 23 of the projecting portions 20 and 21 of the middle portion 13 of the articulated portion 11 and, at the other end, by the lengthwise flange 17 of the articulated portion 11 and the flange 25 of the articulated portion 12. It should be noted that the sizing of this passage is such that the safety device 1 can be moved lengthwise along the lengthwise portion 2 of the beam section 3.

In order to hold together the articulated portions 11 and 12 of the safety device 1 in a closed position which can be seen in FIG. 1, provision is made for suspending the load, not shown, by means of an openable ring 31 which passes through corresponding orifices 19*a* and 27*a* provided through the lug 19 of the articulated portion 11 and of the extension 27 of the transverse lug 26 of the articulated portion 12, this ring 31 preventing the lug 19 and the extension 27 from moving apart.

Figure 3:
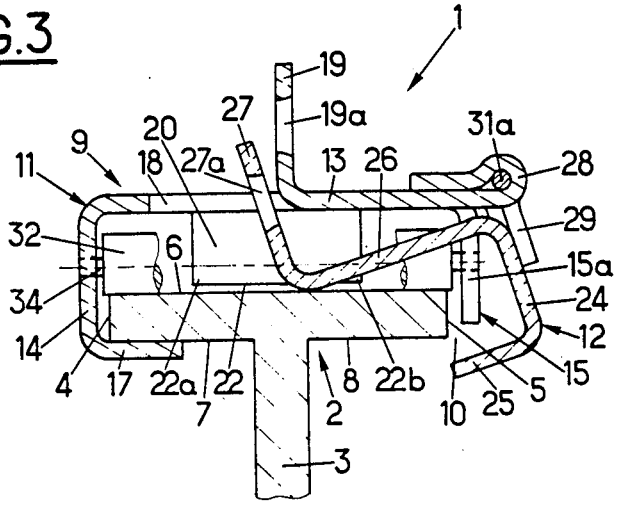
FIG. 3 shows a cross-section of the antifall safety device of FIG. 1, in a corresponding view, in open position.

When the openable ring 31 is taken off, the articulated portion 12 can be made to pivot with relation to the articulated portion 11, around the lengthwise articulation axis 31*a*, so as to bring it into the open position which can be seen in FIG. 3. In this position, the lug 26 and its extension 27 of the articulated portion 12 are at a distance from the middle portion 13 and from the lug 19 of the articulated portion 11, the side wall 24 of the articulated portion 12 is at a distance outwards from the side wall 15 of the articulated portion 11 and the flange 25 of this articulated portion 12 is at a wide distance from the lengthwise surface 8 of the beam section 3. In this open position, which can be seen in FIG. 3, the safety device 1 may be freed and separated from the lengthwise portion 2 of the beam section 3.

In order to refit the safety device 1 on the lengthwise portion 2 of the beam section 3, it suffices to arrange the two articulated portions 11 and 12 in the open position which can be seen in FIG. 3 and to make them pivot in the opposite direction relative to each other until they come into the position which can be seen in FIG. 1.

The safety device 1 can then be mounted onto the beam section 3 anywhere along its length.

In addition, it can be seen that the safety device 1 comprises two transverse rollers 32 and 33, made of a resilient material such as rubber, which are mounted on two pivots 34 and 35 whose ends are carried by the two opposed side walls 14 and 15 of the articulated portion 11, these rollers being arranged between the middle portion 13 of the articulated portion 11 and the external lengthwise surface 6 of the beam section 3 and acting lightly on this surface in the direction of the lengthwise flanges 17 and 25 of the articulated portions 11 and 12.

Thus the safety device 1 may be readily moved along the beam section 3 and, in addition, it can remain stationary in a chosen position.

The way in which the safety device 1 mounted on the lengthwise portion 2 of the beam section 3, shown in FIGS. 1 to 4, operates will now be described.

Figure 4:
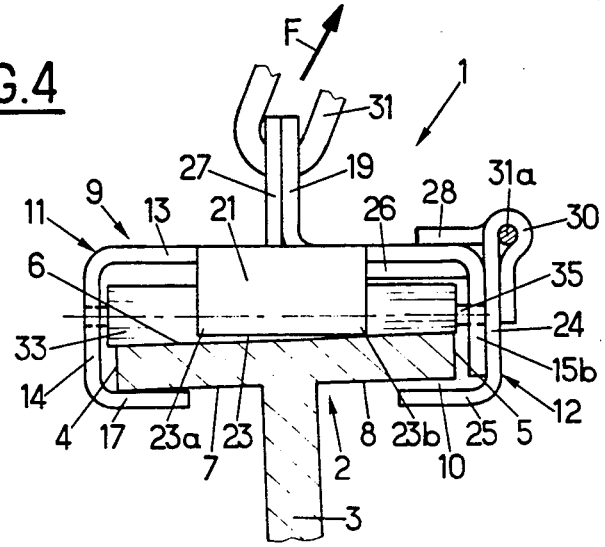
FIG. 4 shows an end view of the antifall safety device of FIG. 1 in operating position.

When a load suspended from the safety device 1 by means of the openable ring 31 pulls on the latter, it is brought, for example, from the nonworking position which can be seen in FIG. 1 to the working position which can be seen in FIG. 4.

Under the action of the pull of the load, for example along the arrow F, the safety device 1 tilts, and a wedging action is produced by the lengthwise portion 2 of the beam section 3 in the passage 10 defined by the opposed side walls 14 and 15 and the end edges 22 and 23 of the projecting portions 20 and 21 and of the lengthwise flanges 17 and 25. Furthermore, the corners 23*a* and 23*b* of the projecting portions 20 and 21 come to bear on the external lengthwise surface 6 of the beam section 3 and produce a punch action on this surface, the wedging action and the punch action combining together to hold the safety device 1 firmly in relation to the lengthwise portion 2 of the beam section 3.

Naturally, the working example described above is not limiting. In fact, for any other directions of action of the load in relation to the beam section 3, the tilting of the safety device 1 produces the wedging action and the punch action, the latter being produced by any one of the corners 22*a*, 22*b*, 23*a* and 23*b* of the projection portions 20 and 21 on the outer lengthwise surface 6 of the beam section 3, depending on the tilt.

A description of another antifall safety device indicated generally by reference 100 will now be given with reference to FIGS. 5 to 8.

As in the preceding example, this device 100 is suitable for being mounted on a portion 101 of a beam section 102 which comprises two opposed edges 103 and 104, an external lengthwise surface 105, and two lengthwise surface portions 106 and 107.

The safety device 100 comprises a body indicated generally by reference 108, which comprises two articulated rigid portions 109 and 110, with a C-shaped cross-section, surrounding at a distance the edges 103 and 104 of the beam section 102. Between the arms 111 and 112 of the body portion 109 as the arms 113 and 114 of the body portion 110, which extend substantially parallel to the lengthwise surface portions 106 and 107 and to the outer lengthwise surface 105 of the beam section 102, there are arranged opposed roller wheels 115 and 116, which are mounted on these arms by means of pivots 117 and 118, these roller wheels 115 and 116 being furthermore mounted on the pivots 117 and 118 by means of rings made of a resilient material 119 and 120, around which the roller wheels 115 and 116 can turn and move axially.

The roller wheels 115 and 116 have annular grooves 121 and 122 of V-shaped cross-section which can be entered by the lengthwise edges 103 and 104 of the beam section 102.

The arms 112 and 114 of the body portions 109 and 110 which are situated on the side of the external lengthwise surface 105 of the beam section 102 carry, respectively, a transverse arm 123 and two transverse arms 124 and 125 which extend on each side of the middle arm 123 so as to form a yoke articulated around a lengthwise pivot 126 situated on the side of the body portion 109. The arms 124 and 125 are connected, furthermore, by a lengthwise lug 127 which extends above the middle arm 123, this middle arm 123 carrying at its end a lug 128 extending through the passage defined by the arm 114, the transverse arms 124 and 125 and the lug 127. The articulation pivot 126 and the lug 128 are thus one on each side of the lug 127.

The arms 111 and 113 of the body portions 109 and 110 carry, respectively, two projecting portions 129, 130 and 131, 132, which extend, respectively, in the direction of the lengthwise surface portions 106 and 107 of the beam section 102. Opposite, the arms 112 and 114 of the body portions 109 and 110 also carry projecting portions 133, 134 and 135, 136 which extend in the direction of the external lengthwise surface 105 of the beam section 102. The ends of these projecting portions 129 to 136 come to a point so as to end in a corner shape, the distance separating the ends of each of the pairs of opposed projecting portions being greater than the thickness of the beam section situated between them. In addition, the ends of the projecting portions 129 to 136 are situated at a small distance from the lengthwise edges 103 and 104 of the beam section 102 and the pairs of projecting portions carried by each of the arms 111 to 114 are, respectively, situated on either side of the roller wheels 115 and 116.

In the example, the projecting portions 129 to 136 comprise of studs which are engaged in cavity openings provided in the arms carrying them, in which stop shoulders are provided. It can be seen particular in FIG. 5 that the stud 131 is in a cavity 137 of the arm 113 in which a stop shoulder 138 is provided.

Figure 5:
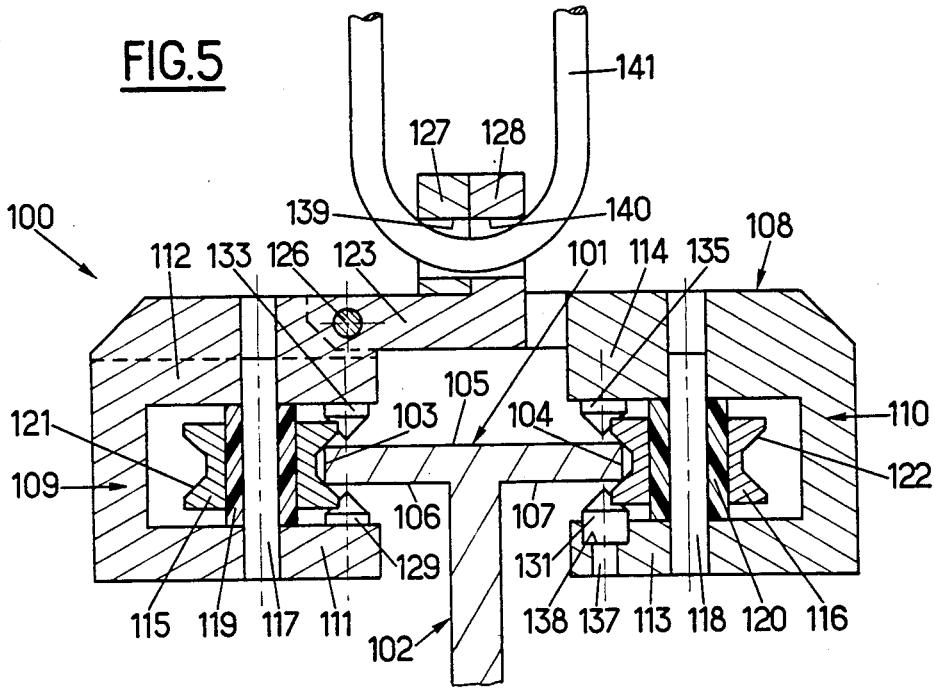
FIG. 5 shows a cross-section of a second antifall safety device according to the present invention, mounted on a beam section, in closed position.
Figure 6:
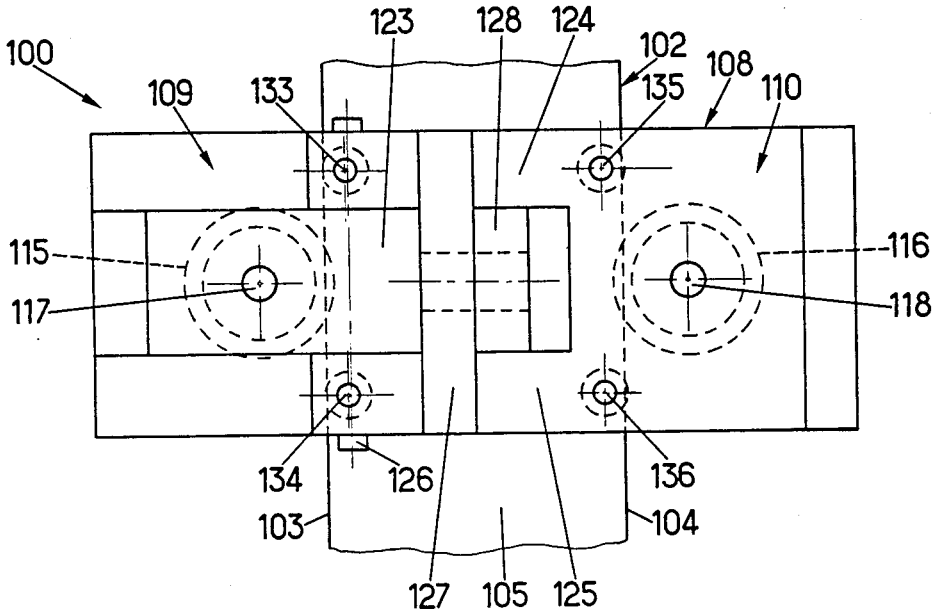
FIG. 6 shows a top view of the antifall safety device of FIG. 5.

As can be seen in FIG. 5, in which the device 100 is shown in closed position, the transverse middle arm 123 of the body portion 109 bears under the lug 127 for joining the transverse arms 124 and 125 of the body portion 110 and the two adjacent lugs 127 and 128 which extend outwards bear on each other, these lugs 127 and 128 having, respectively, passages 139 and 140, through which passes an openable ring 141 which is used to make fast a load, not shown, to the device 100 and which is also responsible for holding the body 108 in closed position. In this closed position, the lengthwise edges 103 and 104 of the beam section 102 are engaged in the grooves 121 and 122 of the roller wheels 115 and 116, the rings of resilient material 119 and 120 being slightly compressed so that the device 100 can be moved along the lengthwise portion 101 of the beam section 102 while being capable of remaining in a chosen position. In addition, the projecting portions 129 to 136 extend in the direction of the surfaces of the beam section 102 facing them.

It can therefore be seen that the arms 112 and 114 form the middle portion of the body 108, that the arms 111 and 113 form flanges of the body 108 and that the roller wheels 115 and 116 form two opposed side walls extending along the lengthwise edges 103 and 104 of the beam section 102.

Figure 7:
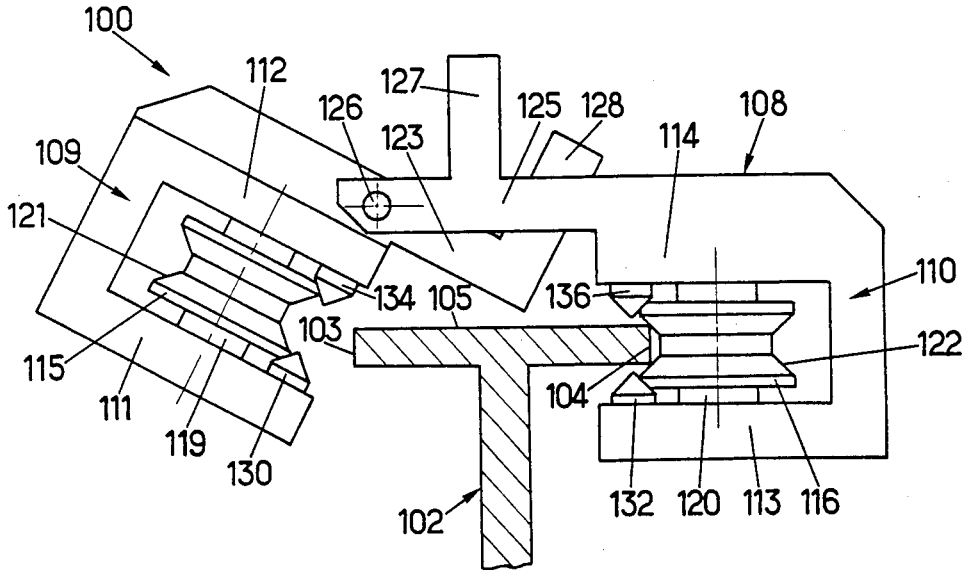
FIG. 7 shows an end view of the antifall safety device of FIG. 5, in open position.
Figure 8:
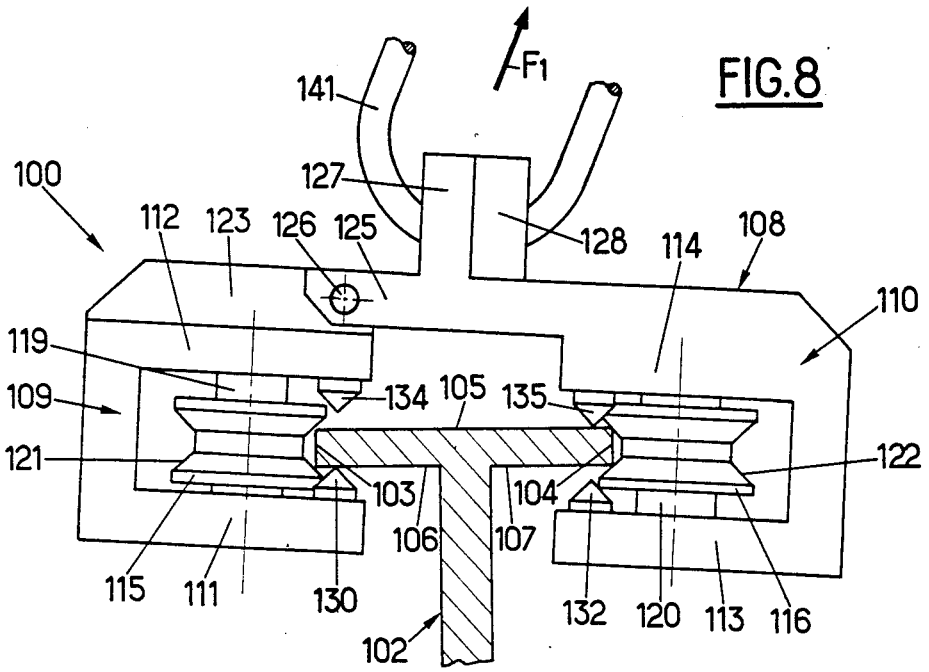
FIG. 8 shows an end view of the antifall safety device of FIG. 5, in a particular operating position.

To separate the device 100 from the beam section 102 it suffices to remove the openable ring 141. The portions 109 and 110 of the body 108 can then be pivoted around the lengthwise pivot 126 so as to release their arms 111 and 113 sideways to the beam section 102, the lug 128 moving away from the lug 127. To mount the device 100 onto the beam section 102 anywhere along its length, the procedure is merely reversed. FIG. 7 shows the device 100 in open position.

When the device 100 is subjected via the ring 141 to a load which acts substantially at right angles to the external lengthwise surface 105 of the beam section 102, the body 108 tilts and moves to bring the projecting portions 129, 130 and 131, 132 to bear on the lengthwise surface portions 106 and 107 of the beam section 102, on which they produce a punch action enabling the body 108 to be maintained on the beam section 102.

When the device 100 is subjected, via the ring 141, to a load which is inclined in relation to the external lengthwise surface 105, the body 108 tilts to apply two pairs of the projecting portions 129 to 136, these pairs being diagonally opposed. These projecting portions bearing on the beam section 102 produce on the latter a punch action which ensures that the device 100 is maintained on the beam section 102. It can be seen, in particular from the whole of FIG. 8, that the body 108 subjected to an inclined load $F_1$ is tilted so that the projecting portions 129 and 130 carried by the arm 111 of the body portion 109 and the projecting portions 135 and 136 carried by the arm 114 of the body portion 110 come to bear and produce a punch action on the lengthwise surface portion 106 and on the outer lengthwise surface 105 of the beam section 102.

When the body 108 is moved or tilted in relation to the portion 101 of the beam section 102, the roller wheels 115 and 116 are capable of moving lengthwise to the pivots 117 and 118 which carry them and transversely to them by virtue of the deformations to which the intermediate rings 119 and 120 of a resilient material can be subjected.

It follows from the preceding description that the safety devices 1 and 100 are capable of self-locking on the lengthwise section of a beam section whatever the direction of action of the load in relation to these devices and whatever the orientation in space of the beam section which carries it, and this by virtue of the tilting of their rigid body and of the punch action produced by at least one projecting portion in their passage which acts on a surface of the beam section. The device 100 has the additional advantage of being capable of being moved along beam sections which incorporate curves.

I claim:

1. Antifall safety device suitable for being mounted on a lengthwise portion of a beam section which comprises two opposed lengthwise edges, an external lengthwise surface connecting these lengthwise edges and two lengthwise surface portions opposed to this external surface and adjacent to said lengthwise edges, comprising a body equipped with means for suspending a load and in which there is provided a C-shaped passage for receiving said lengthwise portion of said beam section, said body having a middle portion facing and at a distance from said external lengthwise surface of said beam section and having two opposed side walls extending along the two lengthwise edges opposed to said beam section and two flanges facing said lengthwise surface portions of said beam section;

said body additionally comprising at least one projecting portion extending from its middle portion towards said external lengthwise surface of said beam section, said projecting portion having at its end at least one corner forming a punch situated between said side walls, said corner producing a punch effect on said external lengthwise surface when under the pull of the load, a tilting of said body is produced together with a wedging effect of said lengthwise portion of said beam section in said passage, said body comprising two longitudinal articulated portions, these portions comprising bearing surfaces and lugs, so that, in closed position, said bearing surfaces are in contact with each other and are adjacent to said lugs and are provided with corresponding orifices for receiving an openable ring for suspending the load for locking said articulated portions and so that, in open position said articulated portions are pivoted around their longitudinal articulating axis in order to move away from said bearing surfaces and said lugs and to disengage at least one of said flanges.

2. Antifall safety device according to claim 1, wherein said middle portion of the body is provided with an additional projecting corner, said two projecting corners forming a punch that is at a distance in the lengthwise direction of the beam section and is capable of producing a punch action on said lengthwise surface of the beam section.

3. Antifall safety device according to claim 1, wherein said middle portion of said body is provided with an additional projecting corner, said two projecting corners forming a punch that is at a distance in the width direction of the beam section and is capable of producing a punch effect on said external lengthwise surface of the beam section.

4. Antifall safety device according to claim 1, wherein at least one of said flanges of said body is also provided with at least one projecting portion extending towards the lengthwise surface portion of the beam section which is situated opposite, said projecting portion having at its end at least one corner capable of producing a punch action on this lengthwise surface portion of the beam section.

5. Antifall safety device according to claim 4, wherein said flange is equipped with an additional projecting portion, said two projecting portions being at a distance in the lengthwise direction of the beam section.

6. Antifall safety device according to claim 1, wherein the opposed side walls extending along the two opposed edges of said beam section comprise at least two opposed bearing members connected to said body by means of resilient members.

7. Antifall safety device according to claim 1, characterized in that the said opposed side walls extending along the two opposed edges of the said beam section consist of at least two opposed roller wheels.

8. Antifall safety device according to claim 7, characterized in that the said roller wheels are mounted on the said body by means of annular resilient members.

9. Antifall safety device according to claim 1, characterized in that the said body carries buffers, in the form of rollers, made of a resilient material acting on the beam section.

10. Antifall safety device suitable for being mounted on a lengthwise portion of a beam section which comprises two opposed lengthwise edges, an external lengthwise surface connecting said lengthwise edges and two lengthwise surface portions opposed to said external surface and adjacent to said lengthwise edges comprising a body equipped with means for suspending a load and in which there is provided a C-shaped passage for receiving said lengthwise portion of said beam section, said body having a middle portion facing and at a distance from said external lengthwise surface of said beam section and having two opposed side walls extending along said two lengthwise edges opposed to said beam section and two flanges facing said lengthwise surface portions of said beam section, said body additionally comprising at least one projecting portion extending from its middle portion towards said external lengthwise surface of said beam section, said projecting portion having at its end at least one corner forming a punch situated between said side walls, so that, under the pull of the load, a tilting of said body is produced, together with a wedging effect of said lengthwise portion of said beam section in said passage, with the corner of said projecting portion of said body bearing on the external lengthwise surface of said beam section and producing a punch effect on said external lengthwise surface, in order to retain said body in relation to said beam section, said body having also at least one first articulated portion comprising its middle portion and its said projecting portions, one of its side walls, and the associated flange, and a second articulated portion comprising a side wall, the other flange and a lug which extends from this side wall between said middle portion and said external lengthwise surface of said beam section, the middle portion of said first articulated portion having a through passage and being provided with an external lug adjacent to said through passage and situated at the opposite end of its side wall, and said lug of said second articulated portion having an extension which extends through the passage of said middle portion, said first and second articulated portions being articulated in the lengthwise direction of the beam section along the adjacent edges of said middle portion of the first articulated portion and of the side wall of said second articulated portion, so that in a closed position the lug of said first articulated portion and the extension of the lug of said second articulated portion are adjacent, said lugs being provided with corresponding orifices through which passes an openable ring for suspending the load and for locking said articulated portions, and that in an open position the second articulated portion is pivoted so that its flange is moved away from the lengthwise surface portion of said beam section which is situated opposite for separating said body from said beam section.

11. Antifall safety device according to claim 10, wherein said first articulated portion comprises the two opposed side walls extending along the opposed lengthwise edges of the beam section, the side wall of said second articulated portion extending outside the side wall of said first articulated portion which is adjacent thereto and which has a passage for the lug of said second articulated portion.

12. Antifall safety device according to claim 10, wherein in closed position the lug of the said second articulated portion bears against the middle portion of said first articulated portion.

13. Antifall safety device according to claim 10, wherein said middle portion of the body is provided with an additional projecting corner, said two projecting corners forming a punch that is at a distance in the lengthwise direction of the beam section and is capable of producing a punch action on said lengthwise surface of the beam section.

14. Antifall safety device according to claim 10, wherein said middle portion of said body is provided with an additional projecting corner, said two projecting corners forming a punch that is at a distance in the width direction of the beam section and is capable of producing a punch effect on said external lengthwise surface of the beam section.

15. Antifall safety device according to claim 10, wherein at least one of said flanges of said body is also provided with at least one projecting portion extending towards the lengthwise surface portion of the beam section which is situated opposite said projecting portion having at its end at least one corner capable of producing a punch action on this lengthwise surface portion of the beam section.

16. Antifall safety device according to claim 15, wherein said flange is equipped with an additional projecting portion, said two projecting portions being at a distance in the lengthwise direction of the beam section.

17. Antifall safety device according to claim 10, wherein the opposed side walls extending along the two opposed edges of said beam section comprise at least two opposed bearing members connected to said body by means of resilient members.

18. Antifall safety device according to claim 10, wherein said opposed side walls extending along the two opposed edges of said beam section comprise at least two opposed roller wheels.

19. Antifall safety device according to claim 18, wherein said roller wheels are mounted on said body by means of annular resilient members.

20. Antifall safety device according to claim 10, wherein body carries buffers in the form of rollers, made of a resilient material acting on the beam section.

21. Antifall safety device suitable for being mounted on a lengthwise portion of a beam section, which comprises two opposed lengthwise edges, an external lengthwise surface connecting said lengthwise edges and two lengthwise surface portions opposed to said external surface and adjacent to said lengthwise edges comprising a body equipped with means for suspending a load and in which there is provided a C-shaped passage for receiving said lengthwise portion of said beam section, said body having a middle portion facing and at a distance from said external lengthwise surface of said beam section and having two opposed side walls extending along said two lengthwise edges opposed to said beam section, and two flanges facing said lengthwise surface portions of said beam section, said body additionally comprising at least one projecting portion extending from its middle portion towards said external lengthwise surface of said beam section, said projecting portion having at its end at least one corner forming a punch situated between said side walls, so that, under the pull of the load, a tilting of said body is produced together with a wedging effect of said lengthwise portion of said beam section in said passage, with the corner of said projecting portion of said body bearing on the external lengthwise surface of said beam section and producing a punch effect on said external lengthwise surface, in order to retain said body in relation to said beam section, said body having also first and second lengthwise articulated portions comprising, respectively, one of said side walls and its associated flange and the portion of said middle portion situated on the side of this side wall, the middle portion of these articulated portions having, in the case of one, a pair of transverse arms connected by a lug extending outwards and, in the case of the other, a transverse middle arm extending between these two arms under said lug, said middle arm having at its end a lug extending outwards, between said pair of transverse arms and on the other side of the lug connecting the latter, said first and second portions being articulated by means of a lengthwise pivot connecting their arms and situated between said lug connecting said pair of arms and the end of the latter, so that in a closed position said lugs are adjacent, these lugs being provided with corresponding orifices through which passes an openable ring for suspending the load and for locking said articulated portions, and that in an open position said articulated portions are pivoted so that their flange is moved away from the lengthwise surface portion of said beam section situated opposite so that said body can be separated from said beam section.

22. Antifall safety device according to claim 21, wherein said articulated portions each carry respectively a said projecting portion forming a punch situated on each side of the lengthwise axis of said beam section.

23. Antifall safety device according to claim 21, wherein said side walls comprise at least two opposed roller wheels each provided with a groove for receiving and for supporting the lengthwise edges of the beam section, said roller wheels being mounted on the portions of the body which carries them by means of a resilient ring and being capable of moving in the direction of the axis of the wheels, each of said articulated portions of said body additionally having portions for connecting their flange and said middle portion.

24. Antifall safety device according to claim 21, wherein said middle portion of the body is provided with an additional projecting corner, said two projecting corners forming a punch at a distance in the lengthwise direction of the beam section and capable of producing a punch action on said lengthwise surface of the beam section.

25. Antifall safety device according to claim 21, wherein said middle portion of said body is provided with an additional projecting corner, said two projecting corners forming a punch at a distance in the width direction of the beam section and capable of producing a punch effect on said external lengthwise surface of the beam section.

26. Antifall safety device according to claim 21, wherein at least one of said flanges of said body is also provided with at least one projecting portion extending towards the lengthwise surface portion of the beam section which is situated opposite, said projecting portion having at its end at least one corner capable of producing a punch action on this lengthwise surface portion of the beam section.

27. Antifall safety device according to claim 26, wherein said flange is equipped with an additional projecting portion said two projecting portions being at a distance in the lengthwise direction of the beam section.

28. Antifall safety device according to claim 21, wherein the opposed side walls extending along the two opposed edges of said beam section comprise at least two opposed bearing members connected to said body by means of resilient members.

29. Antifall safety device according to claim 21, wherein the opposed side walls extending along the two opposed edges of said beam section comprise at least two opposed roller wheels.

30. Antifall safety device according to claim 29, wherein said roller wheels are mounted on said body by means of annular resilient members.

31. Antifall safety device according to claim 21, wherein said body carries buffers, in the form of rollers, made of a resilient material acting on the beam section.

32. Antifall safety device suitable for being mounted on a lengthwise portion of a beam section which comprises two opposed lengthwise edges, an external lengthwise surface connecting these lengthwise edges, an external lengthwise surface connecting these lengthwise edges and two lengthwise surface portions opposed to this external surface and adjacent to said lengthwise edges, said device comprising a body equipped with means for suspending a load and in which there is provided a C-shaped passage for receiving said lengthwise portion of said beam section, said body having a middle portion facing and at a distance from said external lengthwise surface of said beam section, two opposed side walls extending along the two lengthwise edges opposed to said beam section, and two flanges facing said lengthwise surface portions of said beam section, said body having elastic means through which at least one of parts therein is in contact with said beam section and being movable along said beam section, said body additionally comprising at least one projecting portion extending from its middle portion towards said external lengthwise surface of said beam section and having at its end at least one corner forming a punch situated between said side walls, said corner producing a punch effect on said external lengthwise surface when under the pull of the load, a tilting of said body being produced together with a wedging effect of said lengthwise portion of said beam section in said passage, with the corner of the said projecting portion of the said body bearing on the external lengthwise surface of the said beam section and producing a punch effect on this surface, in order to retain the said body in relation to the said beam section, an openable ring, said body comprising two longitudinally articulated portions, these portions comprising bearing surfaces and lugs, so that, in closed position, said bearing surfaces are in contact with each other and are adjacent to said lugs and are provided with corresponding orifices for receiving said openable ring for suspending the load and for locking said articulated portions and so that, in open position, said articulated portions are pivoted around their longitudinal articulating axis in order to move away from said bearing surfaces and said lugs and to disengage at least one of said flanges.

33. Antifall safety device according to claim 32, wherein said middle portion of the body is provided with an additional projecting corner, said two projecting corners forming a punch in the lengthwise direction of the beam section and capable of producing a punch action on said lengthwise surface of the beam section.

34. Antifall safety device according to claim 32, wherein said middle portion of the said body is provided with an additional projecting corner, said two projecting corners forming a punch in the width direction of the beam section and capable of producing a punch effect on said external lengthwise surface of the beam section.

35. Antifall safety device according to claim 32, wherein at least one of said flanges of said body is also provided with at least one projecting portion extending towards the lengthwise surface portion of the beam section which is situated opposite, said projecting portion having at its end at least one corner capable of producing a punch action on said lengthwise surface portion of the beam section.

36. Antifall safety device according to claim 35, wherein said flange is equipped with an additional projection portion, said two projecting portions being at a distance in the lengthwise direction of the beam section.

37. Antifall safety device according to claim 32, wherein the opposed side walls extending along the two opposed edges of said beam section comprise at least two opposed bearing members connected to said body by means of resilient members.

38. Antifall safety device according to claim 32 wherein said opposed side walls extending along the two opposed edges of said beam section comprise at least two opposed roller wheels.

39. Antifall safety device according to claim 38 wherein said roller wheels are mounted on said body by means of annular resilient members.

* * * * *